United States Patent [19]

Maier

[11] Patent Number: 4,520,990

[45] Date of Patent: Jun. 4, 1985

[54] DEVICE FOR SEPARABLY CONNECTING NEIGHBORING PANELS IN CONCRETE FORMS

[76] Inventor: Josef Maier, Schwimmbadstr 3, D-7611 Steinach, Fed. Rep. of Germany

[21] Appl. No.: 480,414

[22] Filed: Mar. 30, 1983

[30] Foreign Application Priority Data

Apr. 10, 1982 [DE] Fed. Rep. of Germany ..... 3213482

[51] Int. Cl.[3] ..... E04G 11/10

[52] U.S. Cl. ..... 249/47; 249/28; 249/167; 249/170; 249/195

[58] Field of Search ..... 249/45, 47, 219 R, 219 W, 249/167, 170, 171, 185, 192, 195, 196, 25, 193, 28, 44

[56] References Cited

U.S. PATENT DOCUMENTS 2,819,861 1/1958 Vines ..... 249/219 W

FOREIGN PATENT DOCUMENTS 2137505 11/1980 Fed. Rep. of Germany .

535731 4/1941 United Kingdom ..... 249/219 R

*Primary Examiner*—Jay H. Woo

*Assistant Examiner*—James C. Housel

*Attorney, Agent, or Firm*—Peter K. Kontler

[57] ABSTRACT

A device which serves to temporarily and releasably connect two neighboring panels of a concrete form has two sections which are coupled to each other by a pivot pin, and two parallel projections each of which is carried by a discrete section. One of the projections is rigidly attached to the respective section, and the other projection is rotatable relative to its section and can be locked to the flange of one of the panels after passing through a keyhole-shaped opening of such flange. The other projection then extends into the opening of the flange which forms part of the other panel. The section for the non-rotatable projection is L-shaped and the other section is a link which can turn about the axis of the pivot pin. The non-rotatable projection is secured to the free end portion of one leg of the L-shaped section and the pivot pin connects the link to the free end portion of the other leg. When the projections are properly inserted into the openings of flanges of two neighboring panels, one of the panels can be moved along an arc about the pivot pin away from the surface of the poured and hardened concrete and is then ready to be fully separated from the remainder of the form in response to extraction of the respective projection from the opening of its flange.

26 Claims, 4 Drawing Figures

DEVICE FOR SEPARABLY CONNECTING NEIGHBORING PANELS IN CONCRETE FORMS

BACKGROUND OF THE INVENTION

The present invention relates to forms, molds or sheathings in general, and more particularly to improvements in forms which can be used for the pouring of concrete or other hardenable plastic materials. Still more particularly, the invention relates to improvements in devices for connecting neighboring panels of a concrete form so that the panels can be separated from one another, especially for connecting neighboring panels which are used to bound the underside of a cavity for the pouring of concrete ceilings or the like and which comprise marginal flanges or ribs for attachment of neighboring rows of panels to each other.

It is known to support the panels of a ceiling form from below by resorting to a set of upright props whose heads can be lifted to raise the panels to a desired level or lowered to allow for detachment of neighboring panels from one another. A drawback of such forms is that the props are rather expensive, primarily because their heads should be mounted for movement toward or away from the underside of a ceiling. Moreover, the props cannot be resorted to in each and every situation, i.e., there are instances when the props cannot be installed below a certain portion of the ceiling so that the respective panels, panel carriers and/or other components of the ceiling form must be secured in requisite position in a different way.

A presently known proposal to dispense with props includes the provision of supporting devices which are designed to engage with one of two neighboring panels of the form and to support from below the adjacent marginal portion of the other panel as soon as the other panel is lowered from its operative position. The thus lowered panel is then ready to be tilted and to be completely removed from the form. The just discussed supporting device has a recess or groove for the marginal portion of the panel which is not positively connected thereto. Such device is quite satisfactory and has found acceptance in the building industry. However, it also exhibits certain drawbacks, particularly lack of requisite versatility (such as the ability to support a tilted panel), excessive space requirements, high initial cost, and bulky and heavy construction.

OBJECTS AND SUMMARY OF THE INVENTION

An object of the invention is to provide a novel and improved device which is constructed and assembled in such a way that it can adequately connect two neighboring panels of a concrete form or the like while the panels are ready for use as well as during detachment or attachment of one of the neighboring panels.

Another object of the invention is to provide a surprisingly compact, inexpensive and versatile connecting device which can be used in connection with all or nearly all existing types of concrete forms, which can be manipulated by skilled, semiskilled or even unskilled persons, and which can be reused as often as desired.

A further object of the invention is to provide a connecting device which enables one of two neighboring panels to support the other panel in any one of a practically unlimited number of different positions including a position in which the other panel is at a level well below and is inclined with reference to the one panel.

An additional object of the invention is to provide a connecting device of the above outlined character which can be attached to the flanges of existing panels forming part of forms for the pouring of concrete ceilings or the like.

Another object of the invention is to provide a connecting device which can be used with advantage in addition to or as a superior substitute for heretofore known supporting devices and/or adjustable props.

Still another object of the invention is to provide the connecting device with novel and improved means for ensuring reliable attachment of its parts to a pair of neighboring panels in a form for concrete ceilings or the like.

A further object of the invention is to provide the connecting device with simple but effective means for temporarily locking its parts to the respective panels of a form for concrete or like plastic materials.

An additional object of the invention is to provide a connecting device which can properly support a fully installed, a partly dismantled or a nearly fully dismantled panel at a level at least partially above the ground or floor.

Another object of the invention is to provide a connecting device which can be used with advantage during dismantling as well as during assembly of a form, e.g., to couple a second panel to a first panel which is already in place whereby the first panel temporarily supports the second panel in suspended condition preparatory to lifting of the second panel to its final position.

An additional object of the invention is to provide a novel and improved method of temporarily suspending and supporting the panels during assembly of a form, particularly a form for concrete ceilings.

A further object of the invention is to provide a connecting device which can be assembled of simple and inexpensive parts, whose space requirements in use or in storage are minimal, which can remain attached to a pair of neighboring panels in a form while the form is in use, and which can couple long, short, heavy, lightweight, wide or narrow panels with equal facility and advantage.

The invention is embodied in a device for separably connecting neighboring panels in a form (particularly for connecting panels of a form which is used for the pouring of concrete ceilings and whose panels bound the mold cavity from below) wherein the panels have aligned flanges and preferably keyhole-panels shaped openings in such flanges. The connecting device comprises a first section including a first projection (e.g., an elongated pin or stud which has a smooth external surface without lateral or radial protuberances and which has a tapering end portion for convenient introduction into and withdrawal from as well as for rotation in the selected opening) which is insertable into an opening of a flange forming part of a first panel, a second section including a second projection (e.g., an elongated pin- or stud-shaped projection with a conically tapering end portion and one or more radially or laterally extending protuberances) which is insertable into an opening of a flange forming part of a second panel adjoining the first panel, and means for movably coupling the first and second sections to each other so that one of the first and second panels and the respective section can be moved with reference to the other panel and the respective section. The coupling means can comprise a simple pivot member which is parallel or nearly parallel to the two projections. The first projection is preferably rigid with the respective section, and the second projection is preferably rotatably mounted in the respective section. This enables the second projection to move through a keyhole-shaped opening when it assumes at least one first angular position relative to the respective flange and to be locked to the respective flange when it assumes at least one second angular position in which its protuberance or protuberances are disposed behind the respective flange and are out of register with the opening.

The first section preferably includes two mutually inclined legs which are welded or otherwise bonded to each other and preferably make an angle of 90 degrees. The first projection is rigid with the free end portion of one leg, and the aforementioned pivot member connects the free end portion of the other leg with the second section which can comprise a link one end portion of which is articulately connected to the other leg and the other end portion of which carries the second projection. The two legs can constitute flat metallic strips which are disposed in parallel planes, and at least the first projection preferably extends at right angles to such planes. The first projection can be longer than the second projection to thus reduce the likelihood of accidental withdrawal from the opening of a flange. The link and the one leg are preferably disposed at one and the same side of the other leg. In order to ensure that the rotatable second projection cannot be accidentally separated from the link, such projection preferably comprises an additional protuberance (e.g., a collar) which is adjacent to one side of the link. The second projection extends through the link and its aforementioned laterally extending protuberance or protuberances are disposed at the other side of the link so that the link is confined between axially spaced protuberances of the second projection; therefore, and since the protuberances cannot pass through the opening which is provided in the link for the rotatable second projection, the latter is permanently attached to the link.

The improved device can further comprise a handle or analogous means for rotating the second projection with reference to the link. The lateral protuberance or protuberances of the second projection are disposed at one side and the handle is disposed at the other side of the link, i.e., the handle is adjacent to the aforediscussed collar of the second projection. The link is preferably pivotable to and from a position of at least substantial parallelism with the one leg of the first section, and the distance between the first projection and the other leg preferably equals or approximates the distance between the other leg and the second projection, at least while the link is at least substantially parallel to the one leg.

The distance between the openings of two aligned flanges which are connected to each other by the improved device can equal or approximate the length of the other leg, i.e., the distance between the pivot member and the locus where the two legs are welded or otherwise rigidly connected to each other. The other leg is substantially parallel to the panels whose flanges are coupled to each other by the improved connecting device, at least while the two panels are disposed in a common plane. At such time, the other leg is spaced apart from the flanges of the two coplanar panels. The one leg is then substantially normal to the panels and the distance between the edge faces of the flanges of such panels and the respective openings is less than the distance between the first projection and the other leg or the distance between the other leg and the second projection. This allows for unimpeded pivoting of one of the panels from a position of parallelism with the other panel, e.g., preparatory to removal of the form from the underside of a freshly poured and hardened ceiling.

The novel features which are considered as characteristic of the invention are set forth in particular in the appended claims. The improved connecting device itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
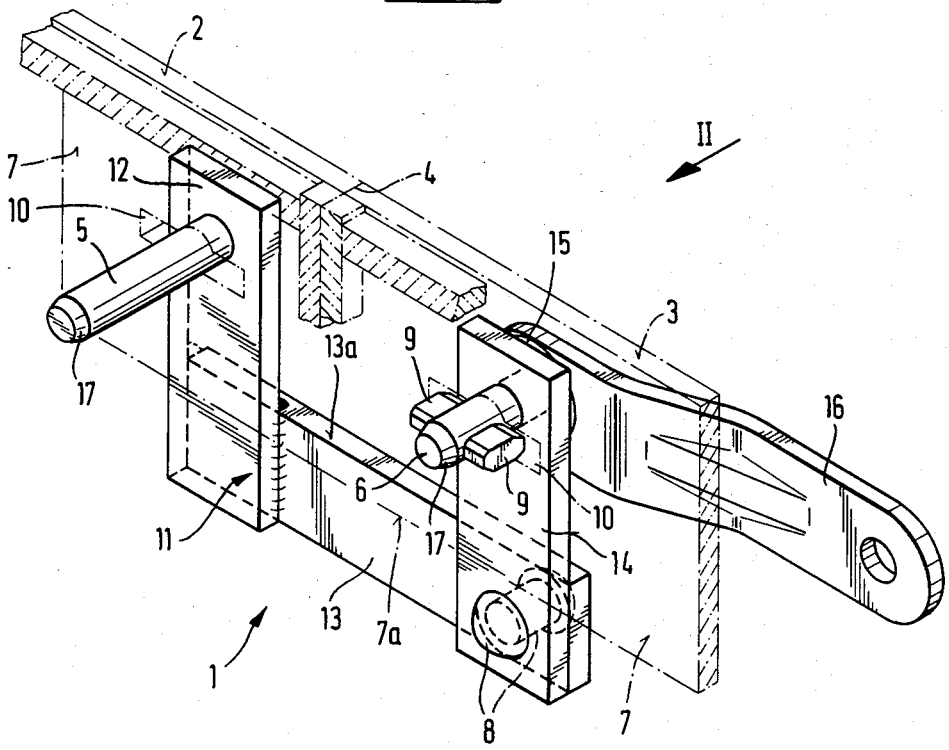
FIG. 1 is a perspective view of a connecting device which embodies one form of the invention and wherein the rotatable projection comprises two radially extending protuberances.
Figure 2:
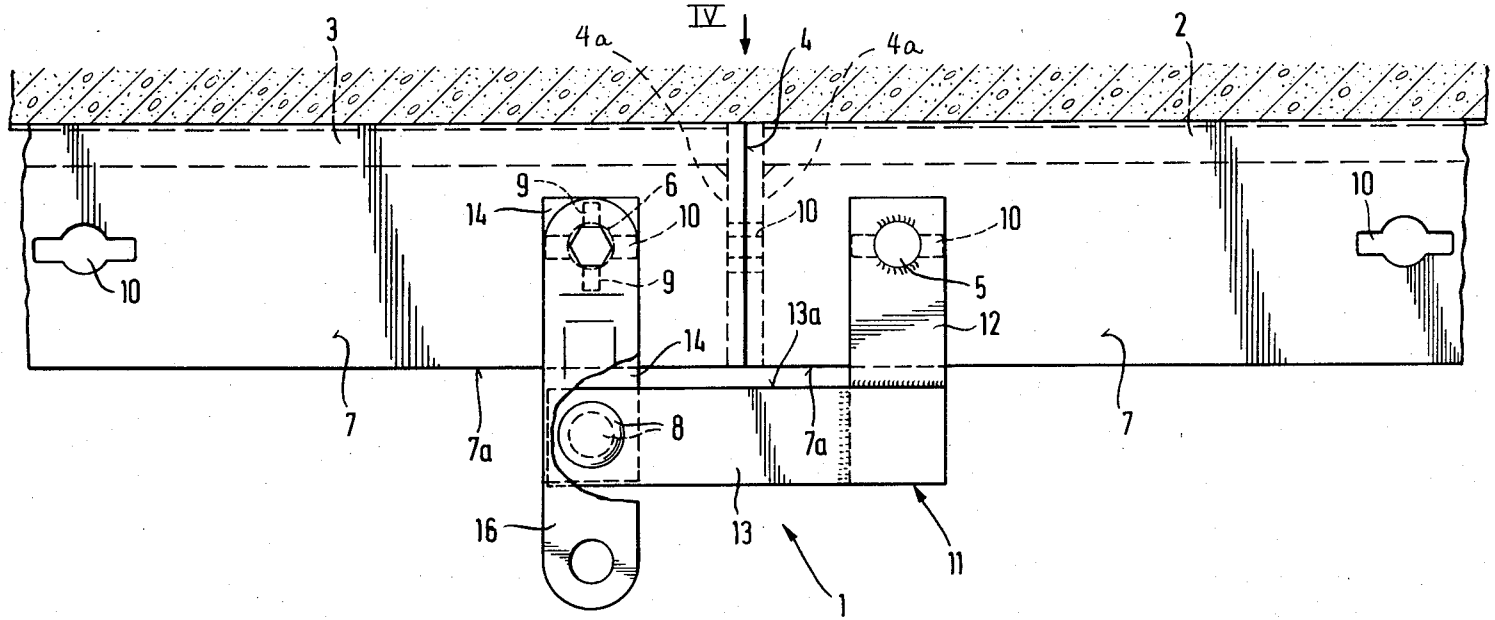
FIG. 2 is an end elevational view of two neighboring panels forming part of an assembled form, the connecting device being shown in the operative position with its projections extending into the openings of flanges at the front ends of the panels.

FIG. 1 shows a connecting device 1 which embodies one form of the present invention and comprises a substantially L-shaped first section 11, an elongated link-shaped second section 14, a pivot member 8 which movably couples the sections 11 and 14 to each other, a first projection 5 which is rigidly secured to (e.g., made integral with) the first section 11, a second projection 6 which is rotatably mounted in the second section (hereinafter called link) 14, and a handle 16 which can be used as a means for rotating the second projection 6 about its axis. The first projection 5 is an elongated cylindrical pin or stud having a preferably frustoconical (tapering) free end portion or tip 17 which facilitates the introduction of this projection into one of several openings 10 provided in the downwardly extending marginal flange or rib 7 forming part of a panel 2 or 3 shown in FIG. 2. The panels 2 and 3 of FIG. 2 are shown in properly installed positions in which their upper sides bound the lowermost part of the cavity for the pouring of a concrete ceiling or the like. The flanges 7 of the panels 2 and 3 are disposed in a common vertical or nearly vertical plane and abut against each other, the same as the edge faces 4 of the two panels. Such edge faces extend at right angles to the plane of FIG. 2. Each of the openings 10 resembles a keyhole in that it includes a substantially circular central portion and two radially extending notches or pockets which provide paths for the passage of laterally (radially) extending protuberances 9 on the rotatable second projection 6 of the connecting device 1.

Figure 4:
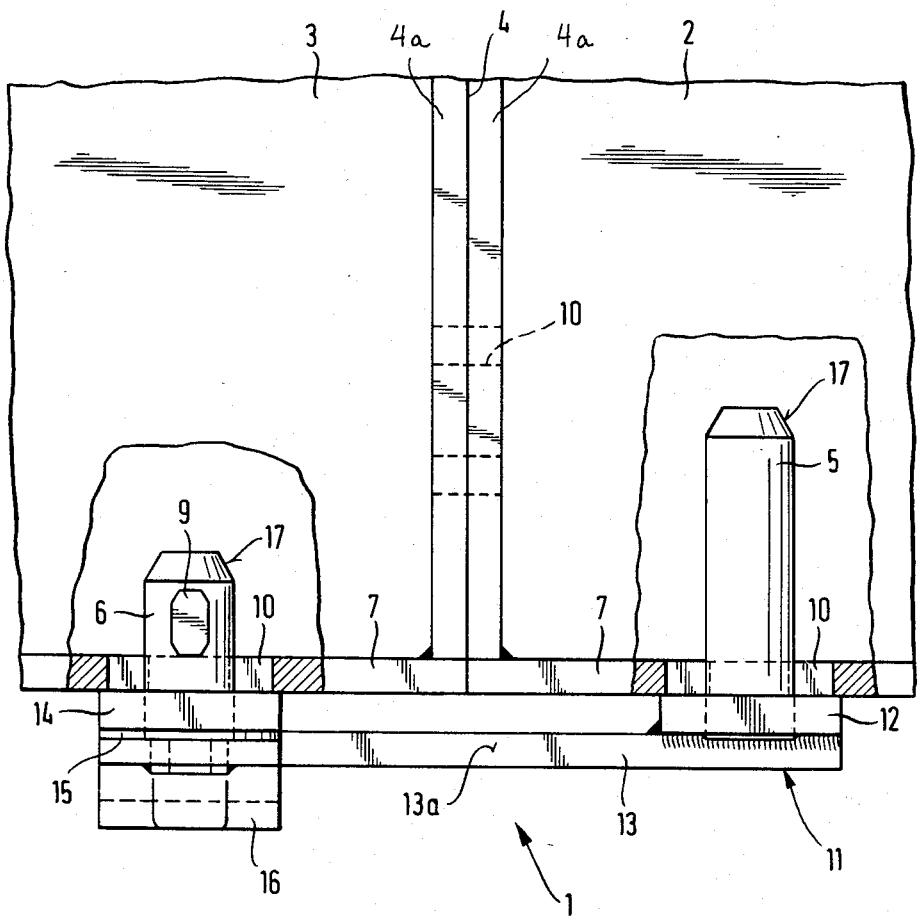
FIG. 4 is an enlarged view as seen in the direction of arrow IV in FIG. 2, with a portion of one of the panels broken away.

The purpose of the flanges 7 is to enable the attendants to attach additional panels in front of the panels 2 and 3 which are shown in FIG. 2, i.e., such additional panels then extend downwardly from the panels 2 and 3, as viewed in FIG. 4. The ribs 4*a* at the edge faces 4 of the panels 2 and 3 can be secured to each other when the panels are properly installed in their operative positions. This dispenses with the need for vertically adjustable props which are used to support the panels of many presently used molds.

FIGS. 2 and 4 further show that, when the panels 2 and 3 are held in the operative positions, their flanges 7 have openings 10 which are closely adjacent to the ribs 4*a*. Such openings 10 are used to receive the projections 5 and 6 of the improved connecting device 1 which is attached and locked to the panel 2 and is more readily separable from the panel 3, or vice versa. As can be seen in FIGS. 2 and 4, the second projection 6 extends into that opening 10 of the left-hand flange 7 which is nearest to the edge faces 4, and the first projection 5 extends into that opening 10 of the right-hand flange 7 which is nearest to the edge faces 4. The distance between the protuberances 9 and the link 14 suffices to ensure that the protuberances 9 are disposed at the inner side whereas the link 14 is disposed at the outer side of the respective flange 7; this guarantees that the projection 6 can be rotated by the handle 16 from a first position in which the protuberances 9 can pass through the lateral pockets of the respective opening 10 to one of numerous second positions in each of which the projection 6 cannot be extracted from the respective opening 10. FIG. 1 shows the projection 6 in an angular position in which its protuberances 9 can readily pass through an opening 10; the handle 16 then extends at right angles to the link 14. Once the projection 6 is properly inserted into an opening 10, the handle 16 is rotated through 90 degrees to be aligned with the link 14 (see FIGS. 2, 3 and 4) whereby the projection 6 is locked to the respective flange 7 and cannot be detached from the panel 2 unless the operator decides to return the handle 16 to the position of FIG. 1. Suitable detent means can be provided to hold the handle 16 in either of the two positions with a requisite force.

Figure 3:
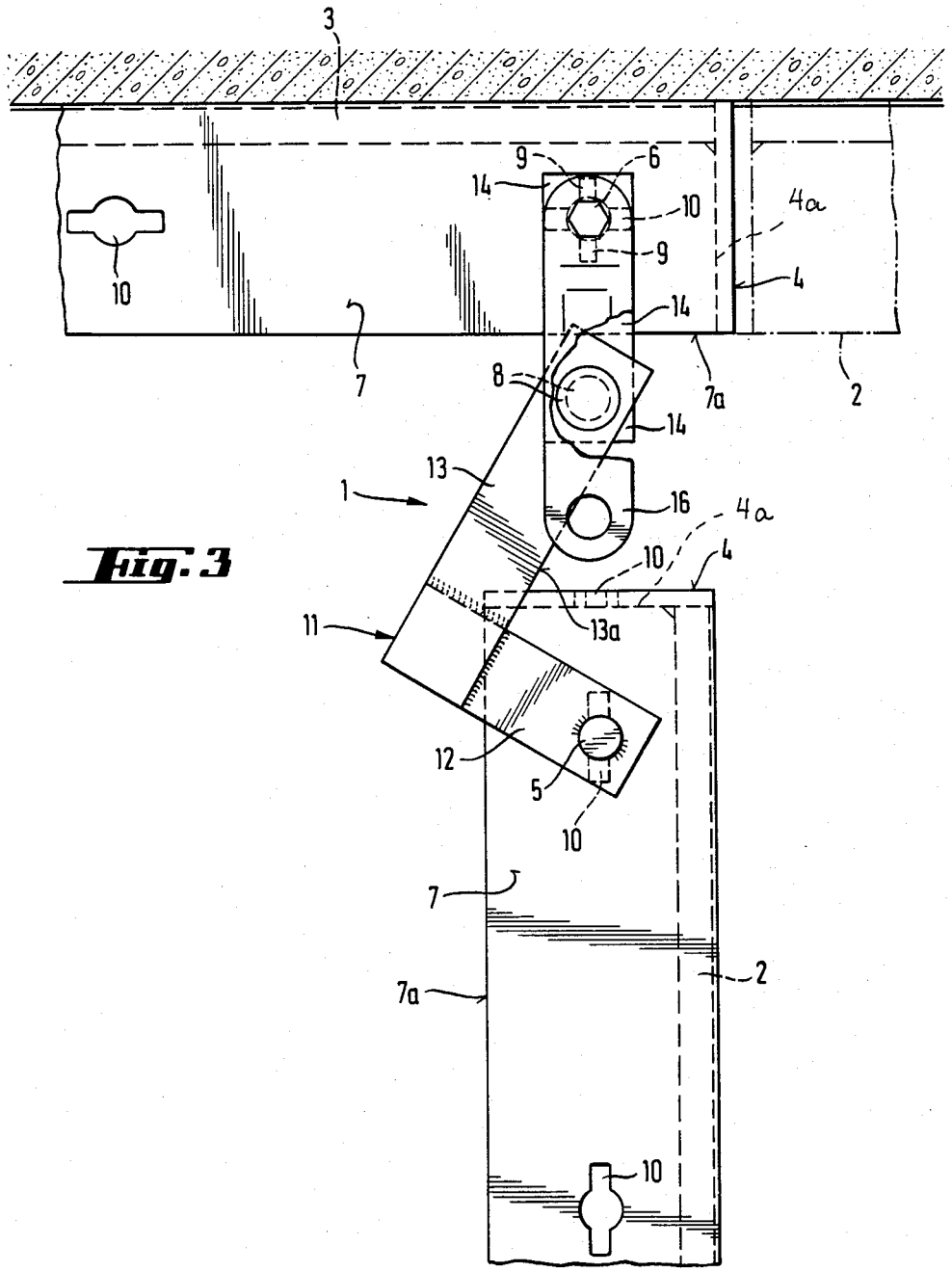
FIG. 3 illustrate the structure of FIG. 2 but with the right-hand panel pivoted through substantially 90 degrees with reference to the left-hand panel and suspended on the respective projection of the connecting device.

The projections 5 and 6 are parallel to each other and are disposed at the same distance from the leg 13 of the section 11 when the link 14 is held in the position of FIGS. 1, 2 or 4, namely, at right angles to the leg 13. The leg 13 extends at right angles to the leg 12 of the first section 11. The free end portion of the leg 12 is rigidly connected with the first pin 5, and the free end portion of the leg 13 carries the pivot member 8 which is parallel to the projections 5 and 6 and enables the section 11 to move to the angular position of FIG. 3 while the link 14 remains attached to the flange 7 of the panel 2. Thus, the panel 3 can pivot relative to the panel 2 by moving along an arc about the axis of the pivot member 8, and such movement can be shared by the section 11 of the connecting device 1. Of course, if the panel 2 is to be detached ahead of the panel 3, it is pivoted (together with the link 14) about the axis of the pivot member 8 so that it is temporarily suspended from the panel 3. In FIG. 3, the axis of the pivot member 8 is substantially coplanar, with the axes of the projections 5 and 6; the panel 2 extends substantially vertically downwardly and its weight is carried by the projection 6 which is locked to the flange 7 of the panel 3. The panel 2 can be readily detached from the section 11 by the simple expedient of moving its flange 7 at right angles to the plane and away from the observer of FIG. 3.

The two protuberances 9 of the second projection 6 can constitute the end portions of a single pin which is inserted into a diametrically extending hole of the projection 6 so that each of its end portions extends beyond the periphery of this projection. Such end portions can be suitably facetted (note FIG. 4) in order to facilitate their passage through the pockets of a selected opening 10, namely, of an opening which is provided in the flange 7 of the panel 3 and is nearest to the edge face 4 of this panel.

The legs 12 and 13 of the first section 11 constitute two pieces of flat iron or other suitable metallic stock and are welded, otherwise bonded or mechanically secured to each other so that they make an angle of 90 degrees. The leg 12 and the link 14 are disposed at the same side of the leg 13, and the projections 5 and 6 are normal or at least substantially normal to the planes of the parts 12, 13 and 14.

The projection 6 is non-removably secured to the link 14 (namely, to that end portion of the link which is remote from the pivot member 8) in that the projection 6 comprises an additional protuberance in the form of a collar 15 (note FIGS. 1 and 4). The collar 15 is disposed at one side and the protuberances 9 are disposed at the other side of the link 14, and the hole of this link (namely, the hole for the projection 6) is too small to permit the passage of the protuberances 9 and/or collar 15. The handle 16 is welded or otherwise non-rotatably secured to the projection 6 at the outer side of the collar 15. If desired, the handle 16 can be detachably secured to the projection 6 by a screw, bolt or the like, not shown.

The distance between the edge faces 7*a* of the flanges 7 and the respective openings 10 is less than the distance between such openings and the edge face 13*a* of the leg 13 (see FIG. 2). In other words, the length of the leg 12 and link 14 is selected in such a way that the edge face 13*a* is spaced apart from the edge faces 7*a* of the flanges 7. This ensures that the panel 2 can be readily pivoted from the horizontal position of FIG. 2 to the vertical or nearly vertical position of FIG. 3 or vice versa. The leg 13 extends transversely of the ribs 4*a* which are used to connect the panels 2 and 3 to each other in the operative positions of such panels. Since the external surface of the projection 5 is smooth and devoid of protuberances, this projection can be readily inserted into, withdrawn from or rotated in the corresponding opening 10 of the flange 7 which forms part of the panel 2. This enables the panel 2 to turn on the projection 5 (or the projection 5 to turn relative to the respective flange 7) while the panel 2 is caused to pivot between the positions which are shown in FIGS. 2 and 3. The length of the projection 5 preferably exceeds the length of the projection 6 because this reduces the likelihood of accidental detachment of the flange 7 of the panel 2 from the leg 12 while the panel 2 is pivoted between the positions of FIGS. 2 and 3. Detachment of the projection 6 from the respective flange 7 is not only unlikely but plain impossible, as long as the handle 16 is held in the angular position which is shown in FIGS. 2, 3 and 4, i.e., as long as the protuberances 9 are out of register with the pockets of the respective opening 10. The attendant is familiar with various angular positions of the handle 16 with reference to the link 14 so that he knows when the angular position of the projection 6 is such that the projection can be inserted into or withdrawn from a hole 10 while the link 14 extends vertically and the respective flange 7 is held in a horizontal position. Of course, this does not preclude the provision of a scale and marker or index means (not specifically shown) to further facilitate immediate and reliable determination of the angular position of the projection 6 with reference to the link 14.

The illustrated connecting device 1 constitutes but one form of means which can be provided in accordance with the invention to separably couple two neighboring panels of a form to each other. The construction of the illustrated connecting device is such that the link 14 is parallel to the leg 12 and that these parts extend at right angles to the respective flanges 7 when the device 1 is properly attached to the panels 2 and 3. This can be readily seen in FIG. 2. Also, and as already described above, at such time the leg 13 extends in parallelism with and is spaced apart from the edge faces *7a* of the flanges 7. The distance between the axis of the projection 6 and the axis of the pivot member 8 equals the distance between the axis of the projection 5 and the level of the axis of the pivot member 8, as viewed in FIG. 2. The axes of the projections 5 and 6 are located in a common horizontal plane because the upper sides of the panels 2, 3 are also assumed to be located in a common horizontal plane and the distance between each of the openings 10 and the lower edge faces *7a* of the respective flanges 7 is the same. Minor deviations of the positions of panels 2 and 3 from optimum positions and/or manufacturing tolerances of the panels, flanges and/or parts of the connecting device 1 are readily compensated for by the pivot member 8 which enables the link 14 to change its angular position with reference to the leg 13 and/or vice versa if such change in angular position is necessary in order to insert the projections 5 and 6 into the selected openings 10 of the respective flanges 7. It will be noted that the coupling means (pivot member 8) of the improved connecting device 1 performs several important functions, namely, it enables the panel 3 to pivot with reference to the panel 2 between the positions which are shown in FIGS. 2 and 3, and it also compensates for manufacturing and/or other tolerances and/or distortion of parts as a result of excessive stressing and/or temperature changes.

When the attendants desire to detach the panel 2, the improved connecting device 1 is attached to the panels 2 and 3 by introducing the projections 5 and 6 into the openings 10 of the respective flanges 7. The projection 6 is then locked to the respective flange 7 by rotating the handle 16 through 90 degrees. This places the improved device in a position of readiness to allow for pivoting of the panel 2 between the positions of FIGS. 2 and 2 and to support the panel 2 in the position which is shown in FIG. 3 for as long as necessary. In the next step, the panel 2 is fully detached from the connecting device 1 by moving the flange 7 of this panel at right angles to the plane of FIG. 3 so that the flange is moved away from the non-rotatable projection 5. Reattachment of the panel 2 to the connecting device 1 and return movement of the panel 2 to the position of FIG. 2 will be effected by reversing the sequence of the aforedescribed steps.

Alternatively, the connecting device 1 can be attached to the panels 2 and 3 of FIG. 2 in the following way; The outermost portion of the non-rotatable projection 5 is inserted into the selected opening 10 of the flange 7 which forms part of the panel 2. This moves the frustoconical tip 17 of the projection 6 close to or into the respective opening 10 of the flange 7 on the panel 3. If the angular position of the projection 6 is such that its protuberances 9 cannot immediately penetrate through the opening 10 to move to the positions which are shown in FIG. 4 (namely, at the inner side of the respective flange 7), the handle 16 is rotated to the position of FIG. 1 whereupon the attendant continues to push the projection 5 into the respective opening so that the projection 6 is also fully inserted and the handle 16 can be rotated to lock the projection 6 to the respective flange 7. The frustoconical tips 17 of the projections 5 and 16 facilitate their insertion into the selected openings 10. FIG. 4 shows the projections 5 and 6 in the fully inserted positions. This Figure further shows that the thickness of the flat link 14 can match or closely approximate the thickness of the leg 12 so that these parts abut against the outer sides of the respective flanges 7 when the projection 6 is locked to the panel 3. The just discussed selection of the thicknesses of parts 12 and 14 (which are located at one and the same side of the leg 13) reduces the likelihood of twisting and/or other deformations of the connecting device 1 during attachment to the neighboring panels 2 and 3.

Once the connecting device 1 is properly attached to the panels 2 and 3, the bolts, screws or other types of fasteners which hold such panels in their operative positions prior to attachment of the connecting device 1 are removed so that the panel 2 can be pivoted to the angular position of FIG. 3. Such bolts, screws or other fasteners are used to connect the ribs *4a* to one another as well as to connect the flanges 7 of the illustrated panels 2 and 3 to the flanges of panels which are located in front of or behind the panels 2 and 3, as viewed in FIG. 2. It goes without saying that a second connecting device 1 can be used to separably couple the second flanges of the panels 2 and 3 to each other so that, when the panel 2 is moved to the position of FIG. 3, each of its ends is suspended on a discrete connecting device.

If the distance between the openings 10 which receive the projections 5 and 6 of the improved connecting device 1 is greater than shown in FIG. 2, the coupling means of the device 1 can be modified by providing two or more locations where the sections 11 and 14 can move relative to each other. The length of the leg 13 conforms to the distance between the openings 10 which are to receive the projections 5 and 6. The illustrated design of the connecting device 1 ensures that the edge face 4 of the panel 2 moves away from the edge face 4 of the panel 3 while the panel 2 is moved away from the underside of the hardened ceiling, i.e., while the panel 2 is caused to move along an arcuate path about the pivot member 8.

If the panel 3 is to be removed ahead of the panel 2, the left-hand flange 7 of FIG. 2 is caused to move along an arcuate path about the pivot member 8, and such movement is shared by the link 14. The panel 2 assumes a substantially vertical position when the axes of the rotary projection 6 and pivot member 8 are located in a common horizontal plane. The panel 3 can be brought to a halt ahead of or after moving beyond such vertical position. In the next step, the panel 3 is detached from the device 1 by rotating the handle 16 with reference to the link 14 until the protuberances 9 are free to pass through the respective opening 10 in the flange 7 of the panel 2. This permits for detachment of the panel 3 from the link 14, and the connecting device is then readily detachable from the panel 3 by the simple expedient of withdrawing the non-rotatable projection 5 from the respective opening 10.

The illustrated configuration of the improved connecting device 1 (substantially L-shaped section 11 and a substantially U-shaped unit including the sections 11 and 14) contributes to the versatility of such device. Thus, the device 1 can be attached to the panels 2 and 3 at the inner or outer sides of the respective flanges 7. This is due to the fact that the leg 13 of the section 11 is then spaced apart from (i.e., it is disposed at a level below) the ribs 4*a* of the panels 2, 3.

It has been found that the improved device 1 can support a panel in suspended position (such as the position of the panel 2 in FIG. 3) for extended periods of time without risking accidental detachment of the suspended panel. This is due to the fact that the smooth-surfaced projection 5 is relatively long so that it is highly unlikely to become accidentally detached from the respective flange 7. The weight of the suspended panel 2 suffices to prevent its flange 7 from sliding along the projection 5 even though the latter has a smooth external surface. The weight of the panel 2 produces sufficient friction to ensure that its flange 7 will not slide along the projection 5 unless such movement of the flange is desired in order to effect complete separation of the panel 2 from the connecting device 1. At any rate, the connection between the device 1 and the panel 2 is much more reliable than by resorting to the aforediscussed conventional supporting device which has a ledge with a recess for the marginal portion of a partially lowered panel. Moreover, the improved connecting device is safer because it can hold the panel 2 in any one of a large number of selected angular positions, i.e., also while the panel 2 is pivoted toward and while the panel 2 is held in the position of FIG. 3.

The improved connecting device can be used as a means for coupling panels which are provided with continuous or interrupted flanges, with short or long flanges, or with thick or thin flanges, as long as the flanges have openings which can receive the projections 5, 6 or analogous projections. The flanges invariably extend from those sides of the panels which face away from the mold cavity, i.e., from the underside of a concrete ceiling or the like. Panels of the type which can be used in combination with the improved connecting device are disclosed, for example, in German Pat. No. 21 37 505. This patent also discloses bolts which are somewhat similar to the rotatable projection 6 of the improved connecting device. The utilization of forms of the type disclosed in this patent with the improved connecting device brings about the advantage that the projection 6 can be produced in the machine which produces such bolts. This contributes to lower cost of the entire form as well as of the improved connecting device.

If desired, frictional engagement between a flange 7 and the non-rotatable projection 5 can be so pronounced that it prevents any and all likelihood of accidental detachment of the suspended panel from such projection. However, it has been found that the weight of a suspended panel normally suffices to prevent its flange from accidentally moving lengthwise of the smooth-surfaced projection 5. Thus, final separation of a suspended panel from the improved connecting device is normally possible only when the suspended panel is held and simultaneously moved in the longitudinal direction of the projection 5, or if the suspended panel is held and the projection 5 is moved axially with reference to the flange of the thus held panel. This reduces the likelihood of accidents during detachment of a suspended panel from the connecting device. The L-shaped section 11, the link 14 and the pivot member 8 cooperate to ensure that the panel which is to be detached ahead of the neighboring panel is moved away from the neighboring panel during pivotal movement to the suspended position, i.e., and as shown in FIG. 3, the panel 2 is moved away from the edge face 4 and rib 4*a* of the panel 3 as well as away from the flange 7 of the panel 3.

It goes without saying that the improved connecting device can be used with equal or nearly equal advantage in combination with panels which are not horizontal when they assume their operative positions and with panels which need not be disposed at the underside of a concrete ceiling or the like. Thus, the improved connecting device can be coupled to panels which are inclined or which are disposed in vertical planes while assuming their operative positions. For example, if the panels are disposed in vertical planes when the respective form is fully assembled, the connecting device can serve to support a partially removed panel in or close to a horizontal plane while the remainder of the form continues to carry at least a portion of the weight of the partially detached panel.

I claim:

1. In a form, particularly for the pouring of concrete ceilings or the like, the combination of neighboring first and second panels respectively having aligned first and second flanges and prefabricated openings in such flanges; and a device for separably connecting said panels, comprising a first section including a first projection removably received in an opening of said first flange, a second section including a second projection removably received in an opening of said second flange, and means for movably coupling the first and second sections to each other so that one of said panels and the respective section can be moved with reference to the other panel and the respective section.

2. The combination of claim 1, wherein said coupling means includes a pivot member.

3. The combination of claim 1, wherein said first projection is rigid with the respective section.

4. The combination of claim 1, wherein one of said projections is rotatably mounted in the respective section.

5. The combination of claim 1, wherein said first projection is rigid with and said second projection is rotatably mounted in the respective section.

6. The combination of claim 5, wherein said projections are elongated and at least substantially parallel to each other.

7. The combination of claim 1, wherein said flanges have keyhole-shaped openings and one of said projections is rotatably mounted in the respective section and comprises at least one protuberance extending substantially radially of the axis of rotation of said one projection, said one projection being removably received in the keyhole-shaped opening of the respective flange in at least one first angular position and being locked to such flange in at least one second angular position of said one projection with reference to the respective flange.

8. The combination of claim 1, wherein said first section includes two mutually inclined legs and said second section includes a link, said coupling means including a pivot member connecting said link with one leg of said first section and said first projection being rigid with the other leg of said first section.

9. The combination of claim 8, wherein each of said legs includes an end portion remote from the other leg, said first projection being rigid with such end portion of said other leg and said pivot member connecting the free end portion of the one leg with said link, said second projection being remote from said pivot member.

10. The combination of claim 9, wherein said legs are disposed in parallel planes and said first projection extends substantially at right angles to such planes.

11. The combination of claim 9, wherein said legs make an angle of 90 degrees.

12. The combination of claim 1, wherein one of said projections is rigid with the respective section and has a smooth external surface devoid of protuberances.

13. The combination of claim 1, wherein said first projection is longer than said second projection, said second projection being rotatably mounted in the respective section and having at least one protuberance extending substantially radially of the axis of rotation of said second projection.

14. The combination of claim 1, wherein said second section includes a link having a first side and a second side, said second projection being rotatably and non-separably mounted in said link and having a first protuberance at one side and at least one second protuberance at the other side of said link.

15. The combination of claim 14 wherein said flanges keyhole-shaped openings and second projection and said second protuberance are insertable into and withdrawable from a keyhole-shaped opening in a predetermined angular position of said second projection with reference to the respective flange.

16. The combination of claim 1, wherein one of said projections is rotatably mounted in the respective section and further comprising means for rotating said one projection with reference to the respective section.

17. The combination of claim 16, wherein said one projection extends from one side and said rotating means is disposed at the other side of the respective section.

18. The combination of claim 1, wherein said first section includes two mutually inclined legs having end portions remote from one another, said first projection being rigid with the end portion of one of said legs and said coupling means including a pivot member connecting the end portion of the other of said legs with said second section, said second section including a link which is pivotable to and from a position of at least substantial parallelism with said one leg and said projections being at least substantially equidistant from said other leg.

19. The combination of claim 1, wherein said first projection is elongated and is rotatable in and movable lengthwise into and from the opening of the respective flange.

20. The combination of claim 1, wherein at least one of said projections has a tapering end portion for convenient introduction into the opening of the respective flange.

21. The combination of claim 1, wherein one of said sections comprises two flat metallic strips which are bonded to each other.

22. The combination of claim 1, wherein said first section includes a first and a second leg, said second leg having a first side and a second side and being rigid with said first leg, said second section including a link and said coupling means including pivot means connecting said link to said second leg, said first leg and said link being disposed at one and the same side of said second leg.

23. The combination of claim 1, wherein the openings of said flanges are disposed at a predetermined distance from each other in assembled condition of said panels, said first section including two mutually inclined legs one of which carries said first projection and the other of which is coupled to said second section, said other leg being substantially parallel to said panels.

24. The conbination of claim 23, wherein said coupling means comprises a pivot member and the length of said other leg between said pivot member and said one leg at least approximates said distance.

25. The combination of claim 1, wherein said first section includes two mutually inclined legs one of which carries said first projection and the other of which is coupled to said section, said other leg being spaced apart from said flanges.

26. The combination of claim 25, wherein said one leg is substantially normal to said panels while such panels are at least substantially coplanar with one another, said flanges having edge faces adjacent to but spaced from said other leg and the distance between the openings and the edge faces of said flanges being less than the distance between either of said projections and said other leg.

* * * * *